US008291821B2

(12) United States Patent
Lemelin et al.

(10) Patent No.: US 8,291,821 B2
(45) Date of Patent: Oct. 23, 2012

(54) INFINITELY VARIABLE CUTOFF PRINTING PRESS WITH CONSTANT SPEED PLATE CYLINDER AND INKER

(75) Inventors: Michael Robert Lemelin, Madbury, NH (US); Ken Francis Blaney, Middleton, NH (US); Mark Bernard Dumais, Kennebunk, NH (US)

(73) Assignee: Goss International Americas, Inc., Durham, NH (US)

( * ) Notice: Subject to any disclaimer, the term of this patent is extended or adjusted under 35 U.S.C. 154(b) by 958 days.

(21) Appl. No.: 12/287,424

(22) Filed: Oct. 9, 2008

(65) Prior Publication Data

US 2010/0089265 A1 Apr. 15, 2010

(51) Int. Cl.
*B41F 7/02* (2006.01)

(52) U.S. Cl. ..... 101/217; 101/177; 101/182; 101/185; 101/247

(58) Field of Classification Search ..... 101/217
See application file for complete search history.

(56) References Cited

U.S. PATENT DOCUMENTS

| | | | | |
|---|---|---|---|---|
| 2,208,047 | A * | 7/1940 | Durup | 101/217 |
| 3,261,289 | A * | 7/1966 | Cash et al. | 101/217 |
| 3,797,389 | A | 3/1974 | Wolff | |
| 4,919,047 | A | 4/1990 | Inouye et al. | |
| 5,123,343 | A * | 6/1992 | Willer | 101/176 |
| 5,644,983 | A | 7/1997 | Herrmann et al. | |
| 5,711,225 | A * | 1/1998 | Rasmussen | 101/181 |
| 5,907,997 | A * | 6/1999 | Jackson et al. | 101/180 |
| 5,950,536 | A | 9/1999 | Erbstein | |
| 6,302,018 | B1 * | 10/2001 | Aoyama et al. | 101/247 |
| 6,327,975 | B1 | 12/2001 | Izawa | |
| 6,736,063 | B2 * | 5/2004 | Murata | 101/247 |
| 7,066,088 | B2 | 6/2006 | McLean et al. | |
| 7,341,001 | B2 | 3/2008 | Charette et al. | |
| 2003/0205153 | A1 | 11/2003 | Wadlinger et al. | |
| 2008/0092758 | A1 | 4/2008 | Numauchi | |

FOREIGN PATENT DOCUMENTS

| | | |
|---|---|---|
| DE | 3907366 A1 | 9/1990 |
| DE | 41 04 209 A1 | 8/1992 |
| EP | 1 084 832 A1 | 3/2001 |
| FR | 980.734 | 5/1951 |
| WO | WO 95/20488 | 8/1995 |

* cited by examiner

*Primary Examiner* — Jill Culler
(74) *Attorney, Agent, or Firm* — Davidson, Davidson & Kappel, LLC

(57) ABSTRACT

A variable cutoff printing press is provided. The printing press includes a first plate cylinder rotating at a constant angular velocity and printing on a web during each revolution about a first plate cylinder axis and a first blanket cylinder rotating at varying angular velocities during each revolution about a first blanket cylinder axis. The first blanket cylinder comes in and out of contact with the first plate cylinder during operation. A method of variable cutoff printing is also provided.

21 Claims, 5 Drawing Sheets

| Scenario | Degrees of printing | Degrees of acceleration after printing | Degrees of receiving ink from plate cylinder | Degrees of deceleration after receiving ink | Average surface velocity of blanket while not printing | Surface velocity of plate cylinder |
|---|---|---|---|---|---|---|
| 201 | 180 | 0 | 180 | 0 | Vweb | Vweb |
| 202 | 120 | 60 | 120 | 60 | 2 x Vweb | > 2 x Vweb |
| 203 | 90 | 90 | 90 | 90 | 3 x Vweb | > 3 x Vweb |
| 204 | 72 | 108 | 72 | 108 | 4 x Vweb | > 4 x Vweb |
| 205 | 60 | 120 | 60 | 120 | 5 x Vweb | > 5 x Vweb |

INFINITELY VARIABLE CUTOFF PRINTING PRESS WITH CONSTANT SPEED PLATE CYLINDER AND INKER

The present invention relates generally to printing presses and more particularly to variable cutoff printing presses.

BACKGROUND OF INVENTION

U.S. Pat. No. 5,950,536 discloses a variable cutoff offset press unit wherein a fixed cutoff press is adapted to a variable cutoff press while maintaining the size of the blanket cylinders. A plate cylinder sleeve has a variable outer diameter, whereby a length of an image to be printed is varied proportionally to a variable outer diameter while maintaining an outer diameter of the gapless blanket cylinder sleeve constant. The size of a plate cylinder is changed by using a sleeve mounted over the plate cylinder or adding packing under a plate to increase the diameter of the plate cylinder.

U.S. Pat. No. 6,327,975 discloses a method and apparatus for printing elongate images on a web. A first printing unit prints a first image portion on the web at prescribed spacings, by moving the impression cylinder away from the blanket cylinder each time one first image portion is printed. A second printing unit prints a second image portion on the spacings left on the web by the first printing unit, also by moving the impression cylinder away from the blanket cylinder each time one second image portion is printed. A variable velocity motor rotates each blanket cylinder, while each time the associated impression cylinder is held away to create a space on the web for causing printing of the first or the second printing portion at required spacings.

U.S. Pat. No. 7,066,088 discloses a variable cut-off offset press system and method of operation which utilizes a continuous image transfer belt. The offset printing system comprises at least two plate cylinders adapted to have thereon respective printing sleeves. Each of the printing sleeves is adapted to receive colored ink from a respective ink source. The system further comprises at least a impression cylinder, wherein the image transfer belt is positioned to contact each of the printing sleeves at respective nips formed between respective ones of the plate cylinders and the at least one impression cylinder.

BRIEF SUMMARY OF THE INVENTION

A variable cutoff printing press is provided. The printing press includes a first plate cylinder rotating at a constant angular velocity during each revolution about a first plate cylinder axis and a first blanket cylinder rotating at varying angular velocities and printing on a web during each revolution about a first blanket cylinder axis. The first blanket cylinder comes in and out of contact with the first plate cylinder during operation.

A method of variable cutoff printing is also provided. The method includes, during a single rotation of a first blanket cylinder about a first blanket cylinder axis, rotating the first blanket cylinder and bringing the first blanket cylinder into contact with a first plate cylinder carrying a first image and rotating at a first constant velocity, the blanket cylinder contacting the first plate cylinder and receiving the first image from the first plate cylinder; rotating the first blanket cylinder and bringing the first blanket cylinder out of contact with the first plate cylinder; varying a rotational velocity of the first blanket cylinder after the first blanket cylinder is brought out of contact with the first plate cylinder; rotating the first blanket cylinder and bringing the first blanket cylinder into contact with a web traveling at a second constant velocity, the first blanket cylinder contacting the web and printing the first image on the web; rotating the first blanket cylinder and bringing the first blanket cylinder out of contact with the web; and varying the rotational velocity of the first blanket cylinder again after the first blanket cylinder is brought out of contact with the web.

BRIEF DESCRIPTION OF THE DRAWINGS

The present invention is described below by reference to the following drawings, in which.

DETAILED DESCRIPTION

Figure 1:
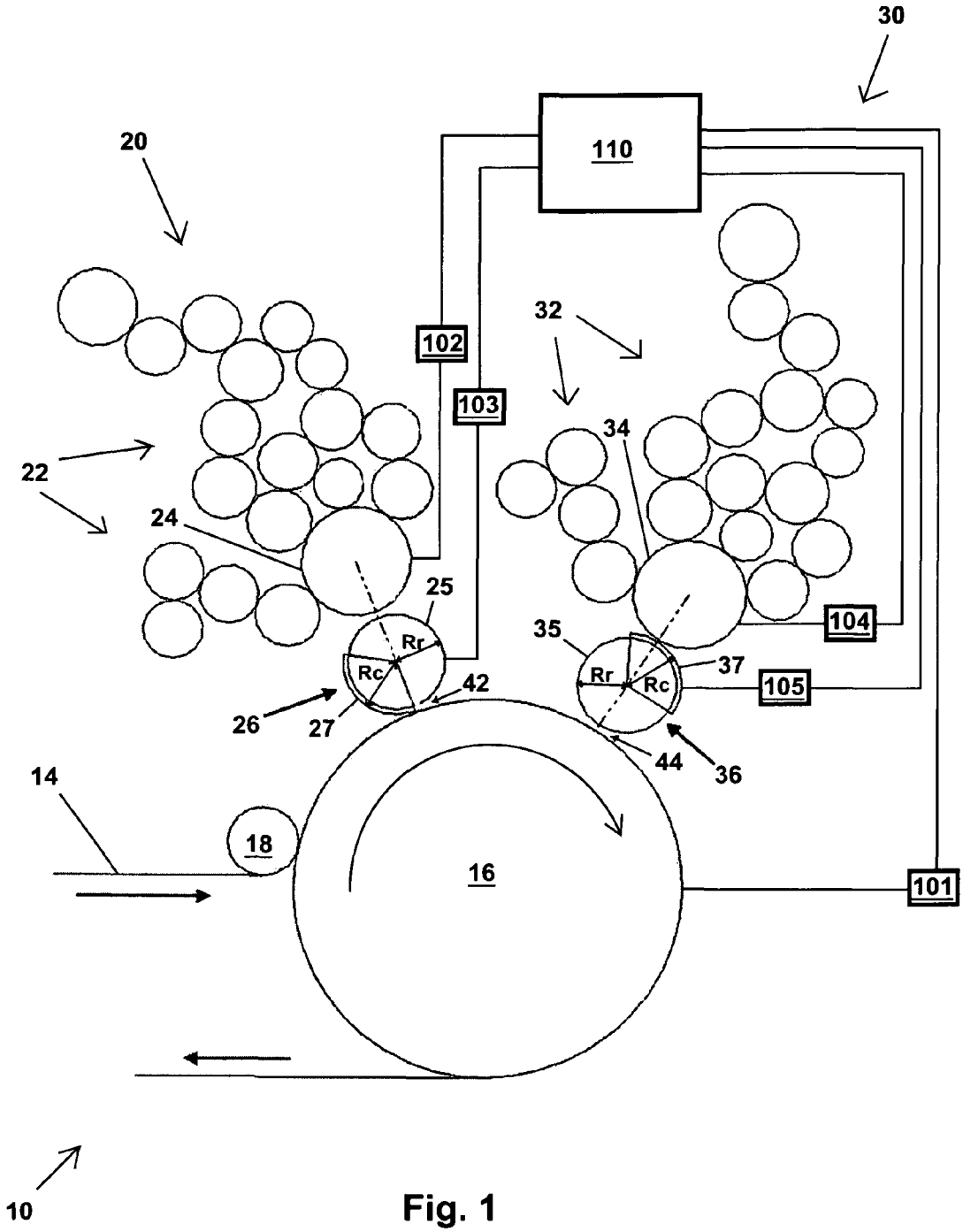
FIG. 1 shows a printing unit of a printing press according to an embodiment of the present invention.

FIG. 1 shows a printing unit 10 of a printing press according to an embodiment of the present invention. Printing unit 10 includes a first printing section 20 and a second printing section 30 printing images on a web 14 as web 14 passes over a central impression cylinder 16. A nip roll 18 guides web 14 as web 14 comes into contact with impression cylinder 16. Each printing section 20, 30 includes inkers 22, 32, a plate cylinder 24, 34, and a blanket cylinder 26, 36, respectively, and prints images on web 14. Inkers 22, 32 provide the same color ink to plate cylinders 24, 34, respectively. Blanket cylinders 26, 36 print images on web 14 at areas 42, 44, respectively, where nips are formed when blanket cylinders 26, 36, respectively, contact web 14.

Inkers 22 disperse ink to plate cylinder 24, which rotates about an axis of plate cylinder 24 and transfers a first inked image to blanket cylinder 26. Blanket cylinder 26 rotates about an axis of blanket cylinder 26 and prints the first inked image on web 14. Axes of blanket cylinder 26 and plate cylinder 24 remain stationary during printing. Inkers 22 and plate cylinder 24 are being rotated so that inkers 22 each have a constant surface velocity that is equal to the surface velocity of plate cylinder 24. Impression cylinder 16 and web 14 also travel at constant velocities so that a surface velocity of impression cylinder 16 equals a velocity of web 14.

The surface velocity of plate cylinder 24 may vary from the surface velocity of impression cylinder 16 and the velocity of web 14. However, while blanket cylinder 26 is receiving a first image from plate cylinder 24 the surface velocity of blanket cylinder 26 is equal to the surface velocity of plate cylinder 24 and while blanket cylinder 26 is printing the first images on web 14 the surface velocity of blanket cylinder 26 is equal to the surface velocity of impression cylinder 16 and the velocity of web 14. Thus, during each 360 degree revolution, if the surface velocity of plate cylinder 24 varies from the surface velocity of blanket cylinder 26, then blanket cylinder 26 accelerates and decelerates during each revolution.

Printing section 30 operates in a manner similar to printing section 20 to print second images on web 14, with inkers 32 and plate cylinder 34 having constant equal surface velocities that may vary from the velocity of web 14 and the surface velocity of impression cylinder 16. As with blanket cylinder 26, blanket cylinder 36 may accelerate and decelerate during each 360 degree revolution when the surface velocity of plate cylinder 34 varies from the surface velocity of impression cylinder 16 and the velocity of web 14.

In this embodiment, a position where blanket cylinder 26 contacts web 14 and a position where blanket cylinder 26 contacts plate cylinder 24 are separated by 180 degrees with respect to the axis of blanket cylinder 26. Also, a position where blanket cylinder 36 contacts plate cylinder 34 and a position where blanket cylinder 36 contacts web 14 are separated by 180 degrees with respect to an axis of blanket cylinder 36. In other embodiments, different angles of separation may be used.

As shown in FIG. 1, blanket cylinders 26, 36 may include relieved portions 25, 35, respectively, to allow blanket cylinders 26, 36 to accelerate and decelerate during each revolution without disrupting the rotation of plate cylinders 24, 34, respectively, or impression cylinder 16 or disrupting the travel of web 14. Relieved portions 25, 35 do not come into contact with plate cylinders 24, 34 or web 14 during normal printing operations. The portions of each blanket cylinder 26, 36 that are not relieved contact plate cylinders 24, 34, respectively, during each revolution and may be referred to as contacting portions 27, 37. Blanket cylinders 26, 36 receive respective first and second images and print the images using respective contacting portions 27, 37. Each contacting portion 27, 37 has a pitch radius Rc that is greater than a pitch radius Rr of each respective relieved portion 25, 35.

In this embodiment, which is a preferred embodiment, printing sections 20, 30 are configured in the same manner, with plate cylinder 24 being the same size as plate cylinder 34, blanket cylinder 26 being the same size as blanket cylinder 36, and contacting portions 27, 37 being the same size. In an alternative embodiment, printing sections 20, 30 may be configured differently from each other.

In operation, blanket cylinder 26 contacts plate cylinder 24 with contacting portion 27 and receives a first image from plate cylinder 24. After contacting portion 27 receives the first image from plate cylinder 24 and contacting portion 27 is no longer in contact with plate cylinder 24, blanket cylinder 26 may be accelerated or decelerated so that contacting portion 27 has a surface velocity that is equal to the velocity of web 14 when contacting portion 27 contacts web 14. When contacting portion 27 prints the first image on web 14 and is no longer in contact with web 14, blanket cylinder 26 may be accelerated or decelerated so that the surface velocity of contacting portion 27 is equal to the surface velocity of plate cylinder 24 when contacting portion 27 comes into contact with plate cylinder 24 again to receive a next first image. As blanket cylinder 26 contacts plate cylinder 24, blanket cylinder 26 is aligned with respect to plate cylinder 24 so that a first inked image carried by plate cylinder 24 is properly transferred to contacting portion 27. After blanket cylinder 26 receives the next first image and comes out of contact with plate cylinder 24, blanket cylinder 26 may be accelerated or decelerated so that contacting portion 27 has a surface velocity that is equal to the velocity of web 14 as contacting portion 27 contacts web 14 and so that contacting portion 27 is properly aligned to print the next first image on web 14.

After blanket cylinder 26 prints a first image on web 14 and the first image passes by area 44, blanket cylinder 36 prints a second image on web 14 directly behind the first image. As blanket cylinder 36 prints the image, blanket cylinder 36 is being rotated so that the surface velocity of blanket cylinder 36 equals the velocity of web 14 and the surface velocity of impression cylinder 16. After blanket cylinder 36 finishes printing the second image on web 14, blanket cylinder 36 may be accelerated or decelerated so that contacting portion 37 has a surface velocity that equals the surface velocity of plate cylinder 34, and is in proper image receiving position when contacting portion 37 contacts plate cylinder 34 to receive a next second image. After blanket cylinder 36 contacts plate cylinder 34 and receives the next second image and contacting portion 37 is out of contact with plate cylinder 34, blanket cylinder 36 may need to be accelerated or decelerated so that the surface velocity of contacting portion 37 equals the velocity of web 14 and so that contacting portion 37 is in a proper position as blanket cylinder 36 prints the next second image on web 14.

Blanket cylinder 26 prints first images on web 14 that are separated from one another by a distance that is equal to the length of each second image printed by blanket cylinder 36. Blanket cylinder 36 prints second images on web 14 that are separated from each other by a distance that is equal to the length of each first image printed by blanket cylinder 26. Thus, blanket cylinders 26, 36 are phased so that each blanket cylinder 26, 36 prints every other image on web 14 and no unprinted space is left between adjacent first and second images printed by blanket cylinders 26, 36, respectively, on web 14.

In one embodiment, each first image printed on web 14 by blanket cylinder 26 may be a first image portion and each second image printed on web 14 by blanket cylinder 36 may be a second image portion, so that the each first image portion and each second image portion form a single continuous image. Thus, together blanket cylinders 26, 36 may act together to print a single image on web 14.

Each cylinder 16, 24, 26, 34, 36 may be driven by a motor 101, 102, 103, 104, 105, respectively. Motors 101, 102, 103, 104, 105 may be controlled by a controller 110, which acts to ensure that blanket cylinders 26, 36 are traveling at appropriate surface velocities when blanket cylinders 26, 36 contact plate cylinders 24, 34, respectively, and web 14 and that blanket cylinders 26, 36 print images on web 14 at appropriate locations. Motors 102, 104 may also drive inkers 22, 32, respectively. In an alternative embodiment, plate cylinders 24, 34 may be driven by a single motor.

In order to vary a cutoff of images printed by printing unit 10, plate cylinders 24, 34 may be altered so that plate cylinders 24, 34 transfer respective first and second replacement images to blanket cylinders 34, 36. This may be accomplished by removing plates, which may be disposed about plate cylinders 24, 34 and carry the respective first and second images, from plate cylinders 24, 34 and replacing the plates with replacement plates that carry the respective first and second replacement images. When the first and second replacement images are of a length that varies from the length of contacting portions 27, 37, respectively, the velocity that blanket cylinders 26, 36 are rotated and the phasing of blanket cylinders 26, 36 may be adjusted so that blanket cylinders 26, 36 properly receive the first and second replacement images from plate cylinders 24, 34, respectively, and print the first and second replacement images in proper alignment on web 14.

Figures 2A, 2B:
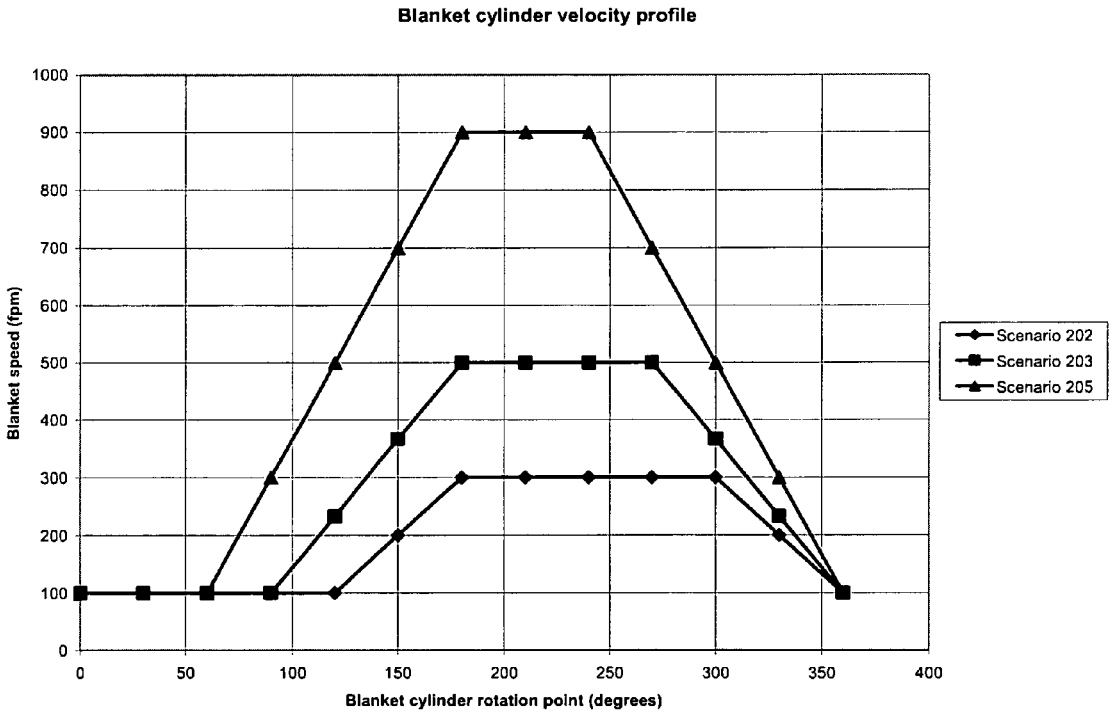
FIG. 2*a* shows a table including predicted results for a printing section of the embodiment shown in FIG. 1.
FIG. 2*b* shows a graph illustrating a surface velocity of a contacting portion of a blanket cylinder, for each revolution of the blanket cylinder, according to the predicted results shown in the table of FIG. 2*a;*

FIG. 2*a* shows a table including predicted results for printing section 20 of the embodiment shown in FIG. 1, under five scenarios 201, 202, 203, 204, 205, where the velocity of web 14 is constant. Because printing sections 20, 30 operate in the same manner, the predicted results may also apply to printing section 30.

For scenario 201, blanket cylinder 26 prints first images on web 14 during 180 degrees of each revolution. The surface velocity of plate cylinder 24 is equal to the velocity of web 14 and blanket cylinder 26 travels at a constant speed during each revolution, with a surface velocity of contacting portion 27 equal to the velocity of web 14. Blanket cylinder 26 does not accelerate or decelerate throughout each revolution.

For scenario 202, blanket cylinder 26 prints first images on web 14 during 120 degrees of each revolution and contacting portion 27 makes up one third of the circumference of blanket cylinder 26. The surface velocity of plate cylinder 24 is more than twice the velocity of web 14. Blanket cylinder 26 accelerates for 60 degrees after printing a first image on web 14 and decelerates for 60 degrees after receiving a first image from plate cylinder 24. After printing a first image on web 14, blanket cylinder 26 rotates 240 degrees in the time it takes web 14 to travel a distance that equals a length of a second image printed by contacting portion 37, in order to be back in proper printing position. While not printing on web 14, contacting portion 27 has an average surface velocity that equals twice the velocity of web 14.

For scenario 203, blanket cylinder 26 prints first images on web 14 during 90 degrees of each revolution. The surface velocity of plate cylinder 24 is more than three times the velocity of web 14. Blanket cylinder 26 accelerates for 90 degrees after printing a first image on web 14 and decelerates for 90 degrees after receiving a first image from plate cylinder 24. After printing a first image on web 14, blanket cylinder 26 rotates 270 degrees in the time it takes web 14 to travel a distance that equals a length of a second image printed by contacting portion 37, in order to be back in proper printing position. While not printing on web 14, contacting portion 27 has an average surface velocity that equals three times the velocity of web 14.

For scenario 204, blanket cylinder 26 prints first images on web 14 during 72 degrees of each revolution. The surface velocity of plate cylinder 24 is more than four times the velocity of web 14. Blanket cylinder 26 accelerates for 108 degrees after printing a first image on web 14 and decelerates for 108 degrees after receiving a first image from plate cylinder 24. After printing a first image on web 14, blanket cylinder 26 rotates 288 degrees in the time it takes web 14 to travel a distance that equals a length of a second image printed by contacting portion 37, in order to be back in proper printing position. While not printing on web 14, contacting portion 27 has an average surface velocity that equals four times the velocity of web 14.

For scenario 205, blanket cylinder 26 prints first images on web 14 during 60 degrees of each revolution. The surface velocity of plate cylinder 24 is more than five times the velocity of web 14. Blanket cylinder 26 accelerates for 120 degrees after printing a first image on web 14 and decelerates for 120 degrees after receiving a first image from plate cylinder 24. After printing a first image on web 14, blanket cylinder 26 rotates 300 degrees in the time it takes web 14 to travel a distance that equals a length of a second image printed by contacting portion 37, in order to be back in proper printing position. While not printing on web 14, contacting portion 27 has an average surface velocity that equals five times the velocity of web 14.

FIG. 2*b* shows a graph illustrating the surface velocity of contacting portion 27 for each 360 degree revolution of blanket cylinder 26 for scenarios 202, 203, 205 shown in the table of FIG. 2*a*. The graph assumes uniform acceleration and deceleration of blanket cylinder 26 between printing on web 14 and receiving images from plate cylinder 24. Web 14 is traveling at a constant velocity of 100 fpm and equals a minimum surface velocity of blanket cylinder 26 in scenarios 202, 203, 205. Each scenario 202, 203, 205 has a different maximum surface velocity, which equals a surface velocity of plate cylinder 24 for the respective scenario 202, 203, 205. For scenario 202, blanket cylinder 26 has a maximum surface velocity of 300 fpm. For scenario 203, blanket cylinder 26 has a maximum surface velocity of 500 fpm. For scenario 205, blanket cylinder 26 has a maximum surface velocity of 900 fpm.

Figure 3:
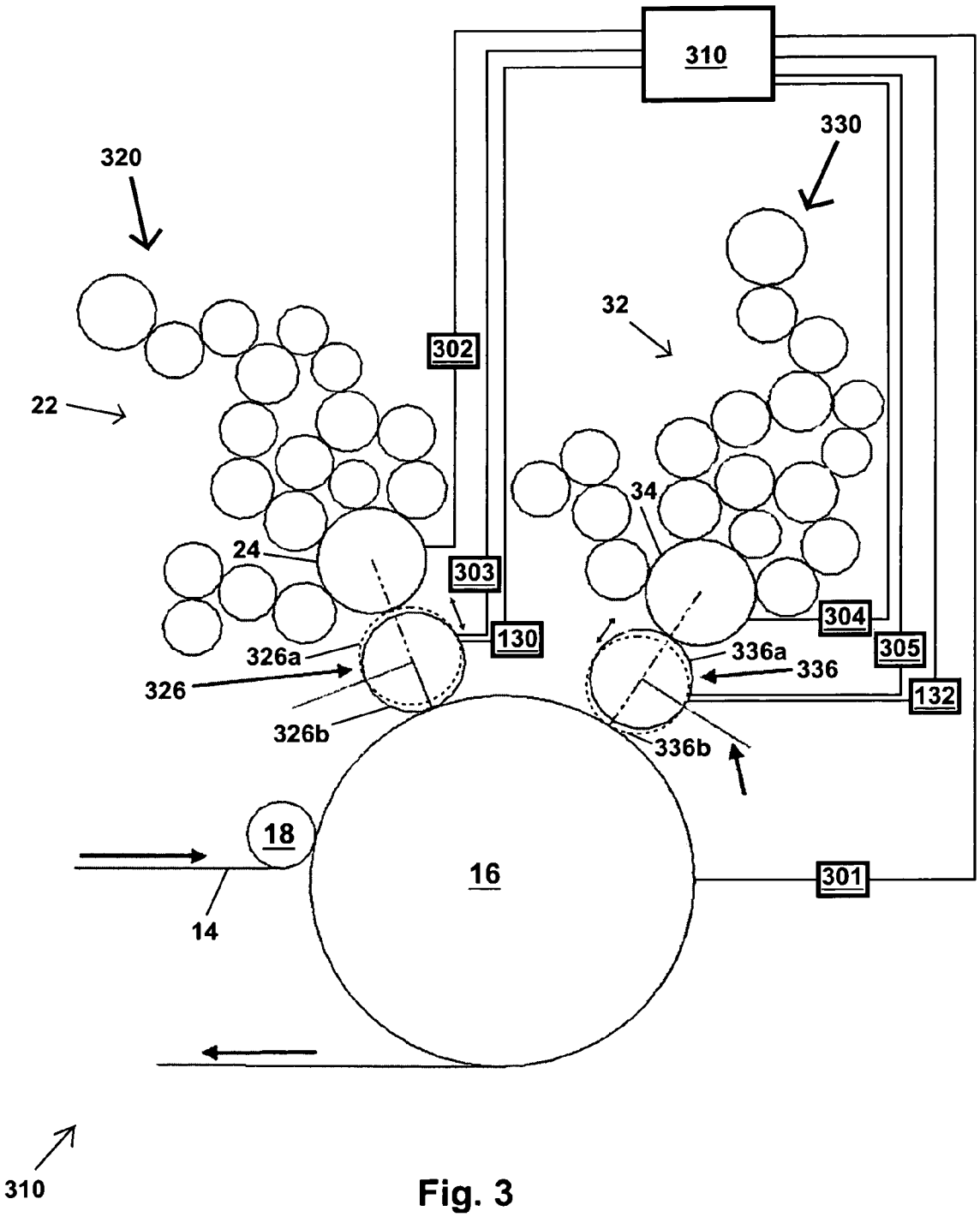
FIG. 3 shows a printing unit of a printing press according to an embodiment of the present invention.

FIG. 3 shows a printing unit 310 of a printing press according to an embodiment of the present invention. Printing unit 310 includes printing sections 320 and 330 that operate in essentially the same manner as printing sections 20, 30 except that blanket cylinders 326, 336 of printing unit 310 do not include relieved portions and contacting portions and the axes of blanket cylinders 326, 336 do not remain stationary during operation. Inkers 22, 32 feed ink to plate cylinders 24, 34, which transfer inked images to blanket cylinders 326, 336.

Blanket cylinder 326 is translated between two positions 326*a*, 326*b* by an actuator 130 during each revolution. In position 326*a*, blanket cylinder 326 receives first images from plate cylinder 24 and a surface velocity of blanket cylinder 326 equals the surface velocity of plate cylinder 24. In position 326*b*, blanket cylinder 326 prints first images on web 14 and the surface velocity of blanket cylinder 326 equals the velocity of web 14. As blanket cylinder 326 is translated between positions 326*a*, 326*b* blanket cylinder 26 may be accelerated or decelerated to ensure that blanket cylinder 326 is traveling at an appropriate velocity when blanket cylinder 326 comes into contact with plate cylinder 24 or web 14.

Blanket cylinder 336 is translated between two positions 336*a*, 336*b* by an actuator 132 during each revolution. In position 336*a*, blanket cylinder 336 receives second images from plate cylinder 34 and a surface velocity of blanket cylinder 336 equals the surface velocity of plate cylinder 34. In position 336*b*, blanket cylinder 336 prints second images on web 14 and the surface velocity of blanket cylinder 336 equals the velocity of web 14. As blanket cylinder 336 is translated between positions 336*a*, 336*b* blanket cylinder 336 may be accelerated or decelerated to ensure that blanket cylinder 336 is traveling at an appropriate velocity when blanket cylinder 336 comes into contact with plate cylinder 34 or web 14.

In order to vary a cutoff of images printed by printing unit 310, plate cylinders 24, 34 may be altered so that plate cylinders transfer first and second replacement images to blanket cylinders 34, 36. This may be accomplished by removing plates, which may be disposed about plate cylinders 24, 34 and carry the respective first and second images, from plate cylinders 24, 34 and replacing the plates with replacement plates that carry the respective first and second replacement images. The velocity that blanket cylinders 326, 336 are rotated and the phasing of blanket cylinders 326, 336 may be adjusted so that blanket cylinders 326, 336 properly receive the first and second replacement images from plate cylinders 24, 34, respectively, and print the first and second replacement images on web 14 so the first and second replacement images are properly aligned and there are no unprinted spaces between the first and second replacement images. The translation of blanket cylinders 326, 336 between respective positions 326*a*, 336*a* and respective positions 326*b*, 336*b* may also be adjusted so that blanket cylinders 326, 336 contact plate cylinders 24, 36 and web 14 for the proper amount of time to receive and print the replacement images on web 14.

Figure 4:
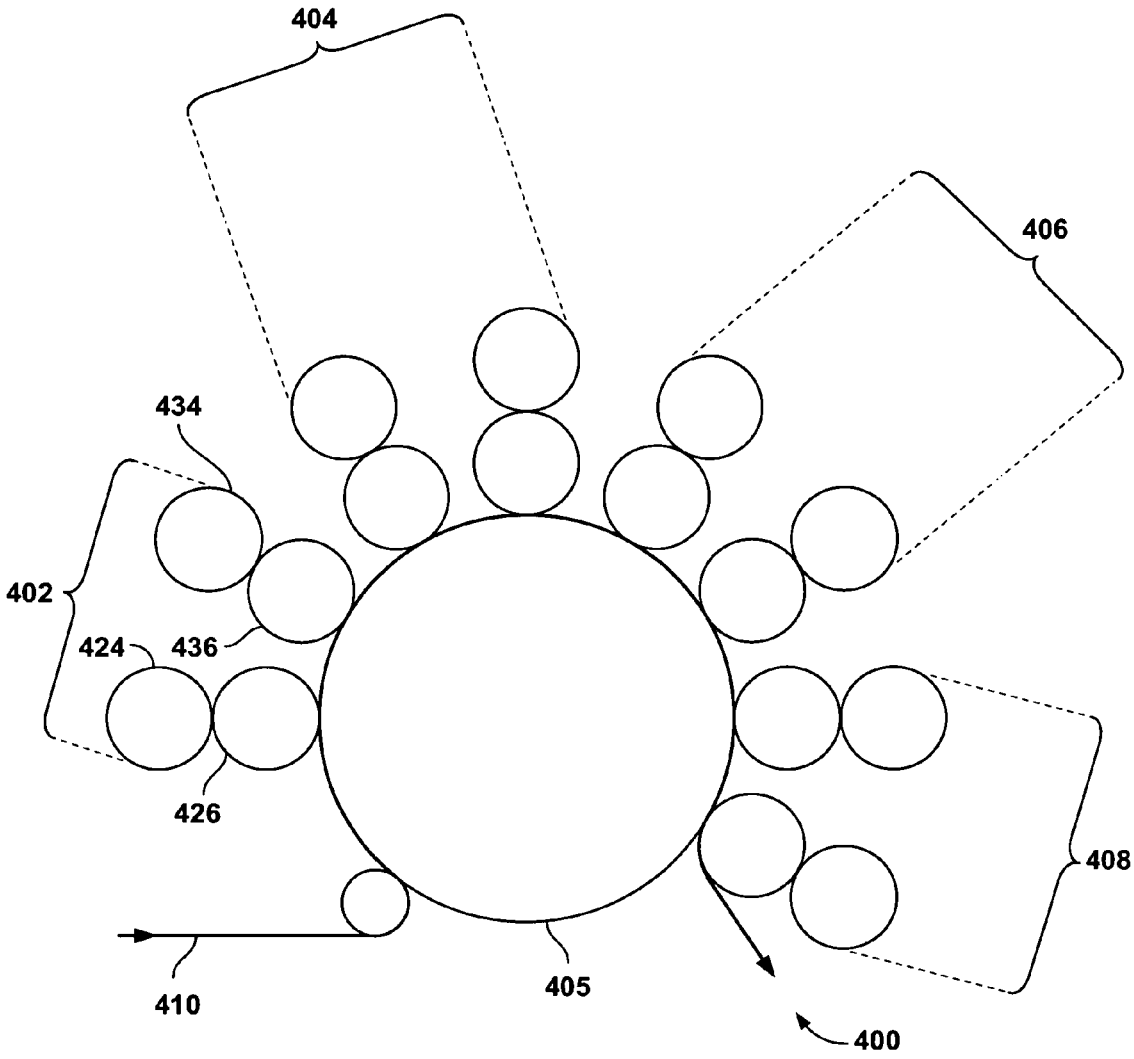
FIG. 4 shows a schematic side view of a four color offset printing press including one central impression cylinder according to an embodiment of the present invention.

FIG. 4 shows a schematic side view of a four color offset printing press 400 including one central impression cylinder 405 according to an embodiment of the present invention. Four printing units 402, 404, 406, 408 are disposed about central impression cylinder 405 and print on a web 410 that passes over an outer surface of central impression cylinder 405. Each printing unit includes two plate cylinders 424, 434 and two blanket cylinder 426, 436, as well as a set of inkers for each plate cylinder 424, 434. Printing units 402, 404, 406, 408 may be configured the same as and operate in essentially the same manner as printing unit 10 shown in FIG. 1 or printing unit 310 shown in FIG. 3. Blanket cylinders 426, 436 may include contacting and relieved portions or blanket cylinders 426, 436 may be translated between positions of contacting web 410 and plate cylinders 424, 434, respectively. Each printing unit 402, 404, 406, 408 prints in a different color on web 410, so that printing units 402, 404, 406, 408 print images that overlap and form four color images on web 410.

Figure 5:
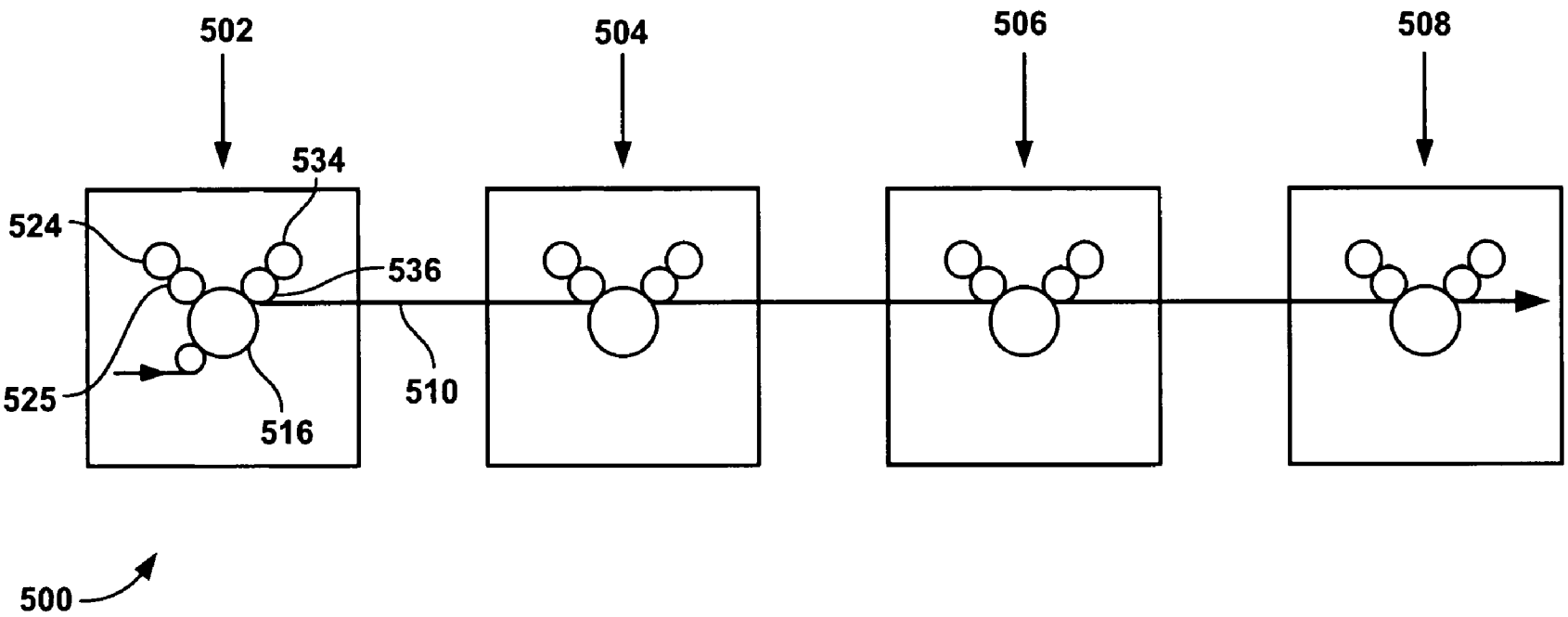
FIG. 5 shows a schematic side view of a four color offset printing press according to an embodiment of the present invention.

FIG. 5 shows a schematic side view of a four color offset printing press 500 according to an embodiment of the present invention. Printing press 500 includes four printing units 502, 504, 506, 508 printing images on a web 510. Each printing unit 502, 504, 506, 508 includes two plate cylinders 524, 534, two blanket cylinder 526, 536, and one impression cylinder 516, as well as a set of inkers for each plate cylinder 524, 534. Printing units 502, 504, 506, 508 may be configured the same as and operate in the same manner as printing unit 10 shown in FIG. 1 or printing unit 310 shown in FIG. 3. Blanket cylinders 526, 536 may include contacting and relieved portions or blanket cylinders 526, 536 may be translated between positions of contacting web 510 and plate cylinders 524, 534, respectively. Each printing unit 502, 504, 506, 508 prints in a different color on web 510, so that printing units 502, 504, 506, 508 print images that overlap and form four color images on web 510. In one alternative embodiment each printing unit 502, 504, 506, 508 may include two impression cylinders in place of impression cylinder 516, with each blanket cylinder 526, 536 contacting one impression cylinder. In another alternative embodiment printing press 500 may be a perfecting printing press with printing units 502, 504, 506, 508 printing on both sides of web 510.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff printing press comprising:

a first plate cylinder;

a first blanket cylinder;

a controller, the controller coupled to the first plate cylinder and the first blanket cylinder, the controller controlling the first plate cylinder to rotate at a constant angular velocity during each revolution about a first plate cylinder axis, the controller controlling the first blanket cylinder to rotate at varying angular velocities during each revolution about a first blanket cylinder axis and to print on a web during each revolution about a first blanket cylinder axis while the first plate cylinder rotates at the constant angular velocity, the first blanket cylinder coming in and out of contact with the first plate cylinder during operation.

2. The variable cutoff printing press recited in claim 1 further comprising:

a second plate cylinder;

a second blanket cylinder;

the controller coupled to the second plate cylinder and the second blanket cylinder, the controller controlling the second plate cylinder to rotate at a constant angular velocity during each revolution about a second plate cylinder axis the controller controlling the second blanket cylinder to rotate at varying angular velocities during each revolution about a second blanket cylinder axis and to print on a web during each revolution about a second blanket cylinder axis axis while the first plate cylinder rotates at the constant angular velocity, the second blanket cylinder coming in and out of contact with the second plate cylinder during operation.

3. The variable cutoff printing press recited in claim 2 wherein the first blanket cylinder receives a first image from the first plate cylinder and prints the first image on the web and the second blanket cylinder receives a second image from the second plate cylinder and prints the second image on the web, the first image directly adjacent to the second image on the web, the first image and the second image being a first color.

4. The variable cutoff printing press recited in claim 3 wherein a surface velocity of the first blanket cylinder equals a velocity of the web as the first blanket cylinder prints the first image on the web and the surface velocity of the second blanket cylinder equals the velocity of the web as the second blanket cylinder prints the second image on the web.

5. The variable cutoff printing press recited in claim 2 further comprising an impression cylinder, the first blanket cylinder and the second blanket cylinder coming in and out of contact with the impression cylinder via the web during operation.

6. The variable cutoff printing press recited in claim 3 wherein the first and second images form a single continuous image on the web, the single continuous image having a first cutoff length.

7. The variable cutoff printing press recited in claim 6 wherein the first plate cylinder can be altered so that the first plate cylinder carries a first replacement image in place of the first image and the second plate cylinder can be altered so that the second plate cylinder carries a second replacement image in place of the second image and the rotation of the first blanket cylinder and the second blanket cylinder can be varied to print the first replacement image directly adjacent to the second replacement image on the web, the first replacement image and the second replacement image forming a single continuous replacement image on the web having a second cutoff length that varies from the first cutoff length.

8. The variable cutoff printing recited in claim 2 further comprising:

a third plate cylinder, a fourth plate cylinder, a fifth plate cylinder, a sixth plate cylinder, a seventh plate cylinder, an eighth plate cylinder, a third blanket cylinder, a fourth blanket cylinder, a fifth blanket cylinder, a sixth blanket cylinder, a seventh blanket cylinder, and an eighth blanket cylinder;

the controller coupled to the third plate cylinder, the fourth plate cylinder, the fifth plate cylinder, the sixth plate cylinder, the seventh plate cylinder, the eighth plate cylinder, the third blanket cylinder, the fourth blanket cylinder, the fifth blanket cylinder, the sixth blanket cylinder, the seventh blanket cylinder, and the eighth blanket cylinder, the controller controlling:

the third plate cylinder to rotate at a constant angular velocity during each revolution about a third plate cylinder axis;

the third blanket cylinder to rotate at varying angular velocities during each revolution about a third blanket cylinder axis and coming in and out of contact with the third plate cylinder during operation;

the fourth plate cylinder to rotate at a constant angular velocity during each revolution about a fourth plate cylinder axis;

the fourth blanket cylinder to rotate at varying angular velocities during each revolution about a fourth blanket cylinder axis and coming in and out of contact with the fourth plate cylinder during operation;

the fifth plate cylinder to rotate at a constant angular velocity during each revolution about a fifth plate cylinder axis;

the fifth blanket cylinder to rotate at varying angular velocities during each revolution about a fifth blanket cylinder axis and coming in and out of contact with the fifth plate cylinder during operation;

the sixth plate cylinder to rotate at a constant angular velocity during each revolution about a sixth plate cylinder axis;

the sixth blanket cylinder to rotate at varying angular velocities during each revolution about a sixth blanket cylinder axis and coming in and out of contact with the sixth plate cylinder during operation;

the seventh plate cylinder to rotate at a constant angular velocity during each revolution about a seventh plate cylinder axis;

the seventh blanket cylinder to rotate at varying angular velocities during each revolution about a seventh blanket cylinder axis and coming in and out of contact with the seventh plate cylinder during operation;

the eighth plate cylinder to rotate at a constant angular velocity during each revolution about a eighth plate cylinder axis; and the eighth blanket cylinder to rotate at varying angular velocities during each revolution about a eighth blanket cylinder axis and coming in and out of contact with the eighth plate cylinder during operation.

9. The variable cutoff printing press recited in claim 8 wherein the first and second blanket cylinders together print a first image of a first color on the web, the third and fourth blanket cylinders together print a second image of a second color on the web, the fifth and sixth blanket cylinder together print a third image of a third color on the web and the seventh and eighth blanket cylinders together print a fourth image of a fourth color on the web, the first, second, third and fourth images forming a four color image on the web.

10. The variable cutoff printing press recited in claim 8 further comprising an impression cylinder, the first, second, third, fourth, fifth, sixth, seventh and eighth blanket cylinders coming in and out of contact with the impression cylinder via the web during operation.

11. The variable cutoff printing press recited in claim 8 further comprising a first impression cylinder, a second impression cylinder, a third impression cylinder and a fourth impression cylinder, the first and second blanket cylinders coming in and out of contact with the first impression cylinder via the web during operation, third and fourth blanket cylinders coming in and out of contact with the second impression cylinder via the web during operation, the fifth and sixth blanket cylinders coming in and out of contact with the third impression cylinder via the web during operation and the seventh and eighth blanket cylinders coming in and out of contact with the fourth impression cylinder via the web during operation.

12. The variable cutoff printing press recited in claim 1 further comprising an impression cylinder, the first blanket cylinder coming in and out of contact with the impression cylinder via the web during operation.

13. The variable cutoff printing press recited in claim 1 wherein a surface velocity of the first blanket cylinder equals a surface velocity of the first plate cylinder as the first blanket cylinder contacts the first plate cylinder, and wherein a surface velocity of the first blanket cylinder equals a velocity of the web as the first blanket cylinder prints the first image on the web.

14. The variable cutoff printing press recited in claim 1 wherein a first motor drives the first plate cylinder and a second motor drives the first blanket cylinder, the controller coupled to the first plate cylinder via the first motor, and the controller coupled to the first blanket cylinder via the second motor.

15. The variable cutoff printing press recited in claim 1 further comprising a plurality of first inkers providing ink to the first plate cylinder, each of the first inkers rotating at a constant surface velocity that equals a surface velocity of the first plate cylinder.

16. The variable cutoff printing press recited in claim 1 wherein the first blanket cylinder includes a relieved portion that allows the first blanket cylinder to come in and out of contact with the first plate cylinder during operation.

17. The variable cutoff printing press recited in claim 1 further comprising a first actuator, the first actuator translating the first blanket cylinder between a position where the first blanket cylinder contacts the first plate cylinder and a position where the first blanket cylinder contacts the web.

18. A method of variable cutoff printing comprising the steps of, during a single rotation of a first blanket cylinder about a first blanket cylinder axis:

rotating the first blanket cylinder and bringing the first blanket cylinder into contact with a first plate cylinder carrying a first image and rotating at a first constant velocity, the blanket cylinder contacting the first plate cylinder and receiving the first image from the first plate cylinder;

rotating the first blanket cylinder and bringing the first blanket cylinder out of contact with the first plate cylinder;

varying a rotational velocity of the first blanket cylinder after the first blanket cylinder is brought out of contact with the first plate cylinder;

rotating the first blanket cylinder and bringing the first blanket cylinder into contact with a web traveling at a second constant velocity, the first blanket cylinder contacting the web and printing the first image on the web;

rotating the first blanket cylinder and bringing the first blanket cylinder out of contact with the web; and varying the rotational velocity of the first blanket cylinder again after the first blanket cylinder is brought out of contact with the web.

19. The method recited in claim 18 further comprising:

rotating a second blanket cylinder and bringing the second blanket cylinder into contact with a second plate cylinder carrying a second image rotating at a third constant velocity, the blanket cylinder contacting the second plate cylinder and receiving the second image from the second plate cylinder;

rotating the second blanket cylinder and bringing the second blanket cylinder out of contact with the second plate cylinder;

varying a rotational velocity of the second blanket cylinder after the second blanket cylinder is brought out of contact with the second plate cylinder;

rotating the second blanket cylinder and bringing the second blanket cylinder into contact with the web traveling at the second constant velocity, the second blanket cylinder contacting the web and printing the second image on the web so the second blanket cylinder prints the second image on the web directly adjacent to the first image;

rotating the second blanket cylinder and bringing the second blanket cylinder out of contact with the web; and varying the rotational velocity of the second blanket cylinder again after the second blanket cylinder is brought out of contact with the web;

wherein the first image and the second image form a single continuous image of a first cutoff length on the web.

20. The method as recited in claim 18 further comprising rotating each of a plurality of first inkers at a constant surface velocity that equals a surface velocity of the first plate cylinder, the plurality of first inkers providing ink to the first plate cylinder.

21. The method recited in claim 18 wherein the first blanket cylinder includes a relieved portion that allows the first blanket cylinder to come in and out of contact with the first plate cylinder.

* * * * *